US010213629B2

(12) United States Patent
Tobias

(10) Patent No.: US 10,213,629 B2
(45) Date of Patent: Feb. 26, 2019

(54) END OF SERVICE LIFE INDICATOR FOR A RESPIRATOR

(71) Applicant: Honeywell International Inc., Morristown, NJ (US)

(72) Inventor: Peter Tobias, Minneapolis, MN (US)

(73) Assignee: Honeywell International Inc., Morris Plains, NJ (US)

( * ) Notice: Subject to any disclaimer, the term of this patent is extended or adjusted under 35 U.S.C. 154(b) by 760 days.

(21) Appl. No.: 13/946,869

(22) Filed: Jul. 19, 2013

(65) Prior Publication Data

US 2015/0020800 A1 Jan. 22, 2015

(51) Int. Cl.
*A62B 18/08* (2006.01)
*A62B 9/00* (2006.01)

(52) U.S. Cl.
CPC ..... *A62B 18/088* (2013.01); *A62B 9/006* (2013.01)

(58) Field of Classification Search
CPC ..... A61B 17/3468; A61B 2017/3492; A61B 2560/0223; A61B 2560/045; A61B 2562/0219; A61B 5/0002; A61B 5/0004; A61B 5/05; A61B 5/1114; A61B 5/14; A61B 5/1411; A61B 5/14503; A61B 5/14507; A61B 5/14514; A61B 5/14532; A61B 5/14546; A61B 5/1473; A61B 5/14735; A61B 5/1486; A61B 5/14865; A61B 5/1495; A61B 5/150022; A61B 5/6801; A61B 5/6814; A61B 5/6825; A61B 5/6832; A61B 5/6833; A61B 5/6848; A61B 5/6849; A61B 5/72; A61B 5/7242; A61M 16/024; A61M 16/0461; A61M 16/0465; A61M 16/06; A61M 16/0666; A61M 16/1015; A61M 16/1045; A61M 16/1055; A61M 2005/1585; A61M 2016/0021; A61M 2016/0027; A61M 2016/0036; A61M 2202/0208; A61M 2202/025; A61M 2205/3368; A61M 2205/3569; A61M 2205/3592; A61M 2205/36; A61M 2205/50; A61M 2205/70; A61M 2230/005; A61M 2230/50; A61M 2230/65; A61M 5/14; A61M 5/14244; A61M 5/1723; A62B 18/088; A62B 9/006; B01D 2271/027; B01D 2279/60; B01D 46/10; B01D 46/521; Y10S 55/31
USPC ..... 128/202.22, 203.14, 204.21, 204.23, 128/206.17, 897, 898, 903; 55/343,
(Continued)

(56) References Cited

U.S. PATENT DOCUMENTS 4,472,356 A * 9/1984 Kolesar, Jr. ..... B01D 46/0086 422/88
4,846,166 A * 7/1989 Willeke ..... A62B 27/00 128/200.24

(Continued)

*Primary Examiner* — Annette Dixon
(74) *Attorney, Agent, or Firm* — Brooks, Cameron & Huebsch, PLLC

(57) ABSTRACT

Systems, methods, and devices for an end of service life indicator for a respirator are described herein. For example, a device can include a cartridge containing a filter material and an insert extending through at least a portion of the filter material having a first path with a first opening to provide a sample of air that is representative of a saturation of the filter material and a second path with a second opening configured to provide a filtered sample of the air throughout a service life of the cartridge.

15 Claims, 6 Drawing Sheets

(58) Field of Classification Search
USPC ..... 55/385.3, 472, 473, 484, 485, 497, 502, 55/DIG. 31; 600/345, 365, 587, 595
See application file for complete search history.

(56) References Cited

U.S. PATENT DOCUMENTS 4,847,594 A * 7/1989 Stetter ..... G08B 21/182 324/666
5,149,435 A * 9/1992 Laube ..... A61L 2/022 210/263
5,666,949 A * 9/1997 Debe ..... A62B 18/088 116/206
5,871,639 A * 2/1999 Hsu ..... B01D 61/04 210/100
5,928,411 A * 7/1999 Falb ..... A61M 16/009 95/129
5,950,621 A * 9/1999 Klockseth ..... A62B 9/006 128/201.25
6,186,140 B1 * 2/2001 Hoague ..... B01D 29/60 128/201.25
6,497,756 B1 * 12/2002 Curado ..... B01D 53/0415 128/201.25
6,894,620 B2 * 5/2005 Reinhardt ..... B01D 46/0086 340/606
7,442,237 B1 * 10/2008 Gardner ..... A62B 18/088 128/202.22
7,749,303 B2 * 7/2010 Wright ..... B01D 53/0454 55/DIG. 34
7,860,662 B2 * 12/2010 Parham ..... A62B 9/006 128/202.22
7,875,100 B2 * 1/2011 Wright ..... B01D 53/0454 55/DIG. 34
7,927,558 B2 * 4/2011 Kirollos ..... G01N 33/0063 2/457
8,365,723 B2 * 2/2013 Poirier ..... A62B 18/088 128/202.22
9,011,584 B2 * 4/2015 Tobias ..... A62B 9/006 128/201.23
9,079,049 B2 * 7/2015 Tobias ..... A62B 9/006
9,283,411 B2 * 3/2016 Larsen ..... A62B 18/088
2002/0047804 A1 * 4/2002 Ghosh ..... H01Q 1/243 343/700 MS
2002/0092525 A1 * 7/2002 Rump ..... A62B 9/006 128/205.23
2008/0283059 A1 * 11/2008 Siegel ..... A61M 16/0045 128/203.25
2010/0194272 A1 * 8/2010 Kubota ..... H01L 51/5281 315/32
2010/0317970 A1 * 12/2010 Gu ..... A61B 5/14551 600/438
2012/0085349 A1 * 4/2012 Tobias ..... A61M 16/105 128/204.22
2013/0047982 A1 2/2013 Tobias et al.
2013/0104733 A1 * 5/2013 Bangera ..... A62B 23/025 95/8

* cited by examiner

END OF SERVICE LIFE INDICATOR FOR A RESPIRATOR

TECHNICAL FIELD

The present disclosure relates to an end of service life indicator for a respirator.

BACKGROUND

Respirators can filter harmful gases that can include contaminants, thus preventing inhalation of the contaminants by a user of the respirator. Respirators can filter contaminants through use of a cartridge that includes a filter material. However, as the respirator is used, the filter material can become saturated with the contaminants and a breakthrough can occur where amounts of contaminants pass through the filter material and can be inhaled by the user.

DETAILED DESCRIPTION

Figure 1A:
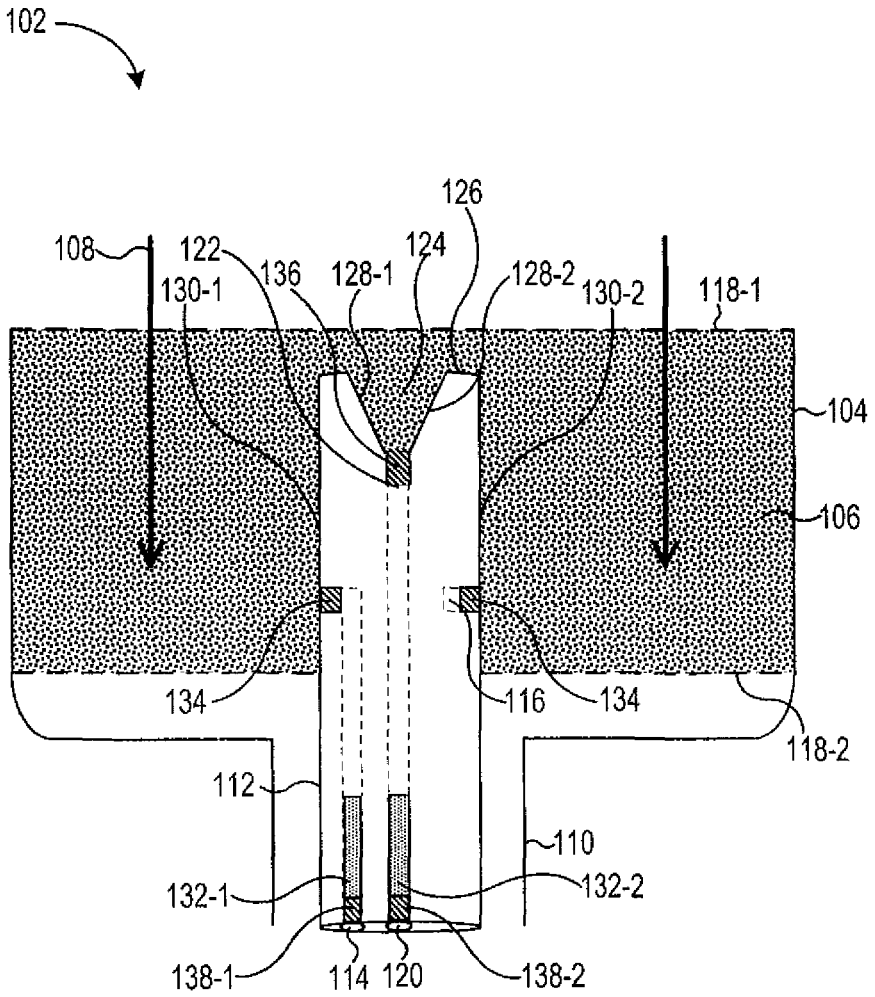
FIG. 1A illustrates a cross section view of a cartridge according to one or more embodiments of the present disclosure.

Use of a respirator can prevent inhalation of contaminants (e.g., harmful gases) by a user of the respirator. However, as the respirator is used, filter material in a cartridge associated with the respirator that is used to filter out the contaminants can become saturated with the contaminants and a breakthrough can occur where amounts of the contaminants pass through the filter material and can be inhaled by the user.

End of service life indicators (ESLIs) can be used to indicate when the cartridge is nearing an end of its service life. For example, an end of service life indicator can indicate when a cartridge should be changed to avoid a scenario where contaminants saturate a filter material associated with the cartridge and thus pass through the cartridge and are inhaled by the user. End of service life indicators can include a sensor to detect the presence of contaminants. In an example, the sensor can include a metal oxide sensor (MOS).

However, signal drift can occur when using MOSs, which can lead to difficulties in detecting a change in concentration of a harmful gas versus drift associated with the sensor. For example, an output associated with the sensor can vary when a concentration of the contaminant remains constant, thus making fluctuations in the signal associated with varying concentrations difficult to detect.

As such, a sample of air that is representative of a saturation of the filter material in the cartridge can be led to the MOS and a reference sample (e.g., a filtered sample of the air containing no contaminants) can be compared with the sample of air that is representative of a saturation of the filter material to compensate for the signal drift associated with the MOS. However, challenges can occur with providing a reference sample that does not contain any contaminants. For example, even though a reference sample contains low concentrations of contaminants, the sensitivity associated with the MOS can cause the concentrations to be detected, leading to errors in detecting concentrations of the harmful gas in the sample of air that is representative of a saturation of the filter material. As such, a signal evaluation may not be adequate for a safety application.

Alternatively, and/or in addition, challenges can occur with power consumption associated with end of service life indicators. In an example, MOSs can be a consumer of power. As such, if power consumption associated with MOSs is reduced, space and/or weight associated with batteries can be reduced in the respirator and/or a time between battery changes can be increased.

Alternatively, and/or in addition, problems can be associated with an MOS after periods of inactivity. For example, if a respirator equipped with an MOS is not used for a period of time and/or a cartridge associated with the MOS is changed, the MOS may come in contact with concentrations of the contaminants, which can negatively impact the accuracy associated with contaminant detection by the MOS.

To help address the limitations associated with prior approaches for detecting the end of service life associated with the cartridge, devices and methods are provided for detecting the end of service life for a respirator. A device can include a cartridge containing a filter material. The device can include an insert extending through at least a portion of the filter material having a first path with a first opening to provide a sample of air that is representative of a saturation of the filter material and a second path with a second opening configured to provide a filtered sample of the air throughout a service life of the cartridge.

In the following detailed description of the present disclosure, reference is made to the accompanying drawings that form a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, electrical, and/or structural changes may be made without departing from the scope of the present disclosure.

The figures herein follow a numbering convention in which the first digit or digits correspond to the drawing figure number and the remaining digits identify an element or component in the drawing. Similar elements or components between different figures may be identified by the use of similar digits. For example, 154 may reference element "54" in FIG. 1B, and a similar element may be referenced as 254 in FIG. 2.

As will be appreciated, elements shown in the various embodiments herein can be added, exchanged, and/or eliminated so as to provide a number of additional embodiments of the present disclosure. As used herein, "a" or "a number of" refers to one or more. In addition, as will be appreciated, the proportion and the relative scale of the elements provided in the figures are intended to illustrate the embodiments of the present invention, and should not be taken in a limiting sense.

FIG. 1A illustrates a cross section view of a cartridge according to one or more embodiments of the present disclosure. The cartridge 102 includes a container 104 containing an air purifying element, such as a filter material 106 for filtering air that enters a first end of the container 104 and flows in the direction shown by arrows 108 toward a second end of the container 104. In some embodiments, the container 104 is cylindrical in shape, and has an adapter 110 coupled at the second end that can be configured to couple to a mask or other device for providing filtered air from adapter 110 end of the cartridge 102 to a user. In an example, the adapter 110 can be configured to provide samples of air to a sensor, as discussed herein. In some embodiments, the container 104 may be formed in other shapes, having cross sections including squares, triangles, rectangles, and other polygons.

As the cartridge 102 is used, the filter material 106 may be used to remove gaseous contaminants. The filter material 106 may become saturated beginning at the point of entry of air into the cartridge 102, and progressing toward the adapter 110 (e.g., in the direction of arrows 108).

Gaseous contaminants can include organic vapors such as alkanes, alkenes, alcohols, ketones, and/or aromatic compounds, and/or other contaminants such as hydrogen sulfide ($H_2S$) and/or ammonia ($NH_3$). Suitable purifying elements may be selected based on the contaminants to be removed from air to be breathed by a user. The filter material 106 may not remove all contaminants, but in some embodiments, the filter material reduces at least one contaminant to acceptable levels.

In some embodiments, a permeable membrane 118-1, 118-2 (e.g., porous filter layer) can be placed over the filter material 106. In an example, the permeable membrane 118-1, 118-2 can be positioned over the filter material to contain the filter material 106. The permeable membrane 118-1, 118-2 can be a filter layer such as an open structure, like a metal, fabric, paper material, etc.

An insert 112 can be positioned within the container 104 extending at least partially through a portion of the filter material 106 to the adapter 110, and also extending through the adapter 110 for connection to the mask. In an example, the insert 112 can include a first path 114 with a first opening 116 configured to provide a sample of air that is representative of a saturation of the filter material 106. In an example, the first opening 116 can be open to the filter material 106 to receive air that has moved through the filter material 106.

The path can extend longitudinally along the insert 112 through a portion of the filter material 106 and through the adapter 110 for providing a sample of air that is representative of the saturation of the filter material 106 to a sensor. In an example, upon initial use of the cartridge 102, a majority, if not all of the contaminants present in air passing through the cartridge 102 can be filtered out by the filter material 106 before the air reaches the first opening 116. As such, the air can be drawn through the first path 114 to the sensor for analysis of whether contaminants are present in the air.

After some use of the cartridge 102, the filter material 106 can begin to become saturated with contaminants and contaminants can start to fill the filter material in a direction of the arrows 108. As such, as air is drawn through the first opening 116, contaminants can also be drawn with the air through the first path 114. The air and contaminants can then be provided to the sensor for analysis via a connection made by the adapter 110 that couples a second end of the insert 112 to the sensor. A determination of whether the filter material 106 has been saturated with contaminants such that the cartridge 102 no longer meets safety requirements can be made.

In some embodiments, the position of the first opening 116 can be selected to be in the filter material toward the second end of the container 104. In an example, this can ensure that there is sufficient filter material to continue to filter air for the user for a desired amount of time prior to replacing the cartridge 102.

In some embodiments, the first opening 116 can include a channel (e.g., ring) that is cut into the insert 112. In an example, the channel can be cut into the insert 112 such that the channel connects with the first path 114. For instance, air and/or contaminants can be drawn into the first path 114 equally from any radial position of the insert 112 through the channel. As such, if contaminants penetrate the filter material 106 more quickly in one area than in another area, the contaminants can still be drawn into the channel that is cut into the insert 112. The channel can be cut deep and long enough to provide a larger sample point and couple to the first path 114. The channel may have parallel sides, or may have angled sides, being larger at the perimeter of the insert 112.

In some embodiments, a permeable membrane may be used to enclose the channel. For instance, the membrane can be positioned over the channel to enclose the channel and the first path 114 and prevent particles (e.g., filter material) from entering into the first path 114. In various embodiments, the membrane can be a filter layer such as an open structure, like a felt or nylon stocking. It may be any type of filter material screening layer or back-holding layer that allows gas to pass and inhibits filter material such as grains or dust from entering the first path 114.

In some embodiments, the insert 112 can include a second path 120 with a second opening 122 configured to provide a filtered sample of air. The second path 120 can extend longitudinally along the insert 112 through the filter material 106 and through the adapter 110 for providing the filtered sample of air to the sensor. In an example, the second opening 122 can be located within a recessed portion 124 of a first end of the insert 126.

In an example, the recessed portion 124 of the first end of the insert 126 can include interior walls 128-1, 128-2 that define the recessed portion 124. In an example, the interior walls 128-1, 128-2 can be parallel to exterior walls 130-1, 130-2 of the insert 112. Alternatively, and/or in addition, the interior walls 128-1, 128-2 can be at an angle to the exterior walls 130-1, 130-2 of the insert 112.

In an example, the recessed portion 124 of the first end of the insert 126 can be filled with filter material 106. The filling of the recessed portion 124 of the first end of the insert 126 with the filter material 106 can occur at a same time as the rest of the container 104 is filled. For instance, the recessed portion 124 and the container 104 can be filled at the same time when the cartridge 102 is being produced. In an example, the recessed portion 124 can contain filter material that is the same and/or different from filter material that is included in the rest of the cartridge 102. For instance, the filter material that fills the recessed portion 124 can be of a different type and/or a different diameter than the filter material filling the rest of the cartridge 102.

In an example, the filter material 106 can include carbon, which can fill the recessed portion 124. As a user breathes, air can be drawn into the recessed portion 124 through the filter material 106 that fills the recessed portion 124 and through the second path 120 to the sensor. In an example, the first path 114 and/or the second path 120 can be connected to an inside of a respirator mask such that when a user takes a breath, a pressure differential is created between the inside of the respirator mask and the first opening 116 of the first path 114 and the inside of the respirator mask and the second opening 122 of the second path 120, thus drawing air into the first path 114 and the second path 120 to the sensor.

In an example, as a user breathes through the cartridge 102, air and/or contaminants can pass through the filter material 106 surrounding the insert 112 at a flow rate of approximately 20 to 30 liters per minute. In contrast, air can pass through the recessed portion 124 of the first end of the insert 126 and into the second path 120 at a flow rate of approximately 1 milliliter per minute. In an example, the recessed portion 124 can provide a flow density associated with the filtered sample of the air through the second opening 122 that is lower than a flow density associated with air passing through the filter material 106 surrounding the insert 112 (e.g., the filter material located to either side of the exterior walls 130-1, 130-2 of the insert 112).

As such, the air passing through the recessed portion 124 of the first end of the insert 126 and into the second path 120 can be filtered of all contaminants because the flow rate is low enough such that the filter material 106 that fills the recessed portion 124 can filter out the contaminants even after the filter material 106 becomes saturated with contaminants. Accordingly, air that passes through the second path 120 can serve as a reference sample for the sensor because no contaminants are contained in the air, thus serving as a baseline for analysis.

In some embodiments, the second path 120 with the second opening 122 can be configured to provide the filtered sample of air throughout a service life of the cartridge 102. In an example, the end of service life of the cartridge 102 can be defined as a time at which a defined concentration of a contaminant is sensed via a sensor in the sample of air that is representative of the saturation of the filter material 106. As such, the cartridge 102 can provide the entire service life of the cartridge. In an example, the cartridge 102 can provide the filtered sample of air after the end of service life has been reached.

For instance, once the filter material 106 becomes saturated, contaminants can pass through the first opening 116 and the first path 114 and be fed to the sensor, which can detect an increase in the concentration of contaminants and generate a signal indicating an end of service life of the cartridge 102. As such, the second opening 122 can be configured to provide the filtered sample of air even though the filter material 106 surrounding the insert 112 is saturated with contaminants. Alternatively, and/or in addition, the second opening 122 can be configured to provide the filtered sample of air for a defined time after the end of service life of the cartridge 102 and/or the filter material 106 surrounding the insert 112 is saturated with contaminants.

Alternatively, and/or in addition, the second opening 122 can be configured to provide the filtered sample of air for a time after a breakthrough has occurred in the cartridge 102. For instance, the filtered sample of air can be provided even after a breakthrough of the filter material 106 surrounding the insert 112 occurs (e.g., contaminants enter the first end of the container 104 and flow in the direction shown by arrows 108 out the second end of the container 104).

In contrast, the filter material 106 surrounding the insert 112 can become saturated with contaminants more quickly than the filter material 106 in the recessed portion 124 because of the increased flow rate of air passing through the filter material 106 surrounding the insert 112. As such, placing the second opening 122 within the recessed portion 124 of the insert 112 can be beneficial versus placing the second opening 122 on a side of the insert 112. In an example, contaminants can saturate the filter material 106 surrounding the exterior walls 130-1 and 130-2 of the insert 112 more quickly than the recessed portion 124 leading to amounts of contaminants in the reference sample and causing errors in analysis of the end of service life of the cartridge 102.

In some embodiments, the sensor can be an MOS. Alternatively, and/or in addition, the sensor can be a photo ionization detector (PID) or other sensor for detecting the contaminants, as discussed herein. Signal drift can occur when using MOSs, which can lead to difficulties in detecting a change in concentration of a harmful gas versus drift associated with the sensor. For example, an output associated with the sensor can vary when a concentration of the contaminant remains constant. As such, it can be important to identify when a signal associated with the sensor is changing due to drift and when the signal is changing due to detection of contaminants.

As such, a sample of air that is representative of a saturation of the filter material can be led to the MOS and a reference sample (e.g., a filtered sample of air containing no contaminants) can be compared with the sample of air that is representative of a saturation of the filter material to compensate for the signal drift associated with the MOS. By providing the air passing through the second path 120 to the MOS, a reference sample is provided to the MOS that contains minimal or no amounts of contaminants, which can be used to account for the signal drift associated with the MOS.

In an example, the MOS sensor can be susceptible to moisture. For instance, humidity in the samples provided through the first path 114 and the second path 120 can cause moisture to accumulate on the MOS sensor, thus making detection of contaminants difficult. The MOS sensor can be heated to dry the air, however, this can decrease sensitivity and increase power requirements associated with the sensor. This can lead to more frequent battery changes and/or use of a larger power source (e.g., battery).

In some embodiments, to reduce power usage, the MOS can be operated in a pulsed mode. For example, the MOS can be heated for a period of time and a measurement can be taken by the MOS. The sensor can then enter an inactive mode for a period of time before being heated again for a period of time and making an additional measurement.

In an example, the MOS can operate in a pulsed mode with a duty cycle of twenty percent or less. For instance, the MOS can be heated 0.2 seconds and a measurement can be taken and then the MOS can enter an inactive state for 0.8 seconds, resulting in energy savings.

However, when the air is humid (e.g., above twenty percent relative humidity), the water can absorb on the MOS during the cold phases and only partly desorb during the hot phases. At the end of the hot phase, there can still be enough water on the sensor to skew the sensor signal and make gas detection difficult. As such, in some embodiments, the gas samples provided to the MOS can be dried further through use of an absorbent.

In an example, absorbent 132-1, 132-2 can be placed in the first path 114 and the second path 120 to dry the air before it contacts the MOS. In an example, the absorbent 132-2 and an additional desiccant can be placed in the second path 120, which can allow for drying the air with the absorbent 132-2 and additionally filtering the air with the desiccant. As such, the reference sample can be further filtered of any contaminants before being analyzed by the MOS.

Treatment of the sample passing through the first path 114 can be different to avoid filtering any contaminants from the sample passing through the first path 114. In an example, a humidity-selective absorbent can be used. For instance, molecular sieves with a pore size of less than 4 angstroms and preferably less than 3.5 Angstroms can be used to absorb water and ammonia. Molecular sieves, such as those described herein, may absorb an amount of organic vapors, however, the amount of organic vapors that are absorbed can be negligible. In an example, the absorbent can be Zeolite.

In an example, the sensor can be configured to provide an indication when a portion of the filter material is saturated based on the sample of air that is representative of the saturation of the filter material. For instance, when the sensor detects that contaminants are present at a defined level, an audible and/or visual indication can be provided to a user indicating that the cartridge has reached an end of its service life.

In an example, the sensor can be configured to provide a signal to a controller (e.g., computing device) when a portion of the filter material is saturated based on the sample of air that is representative of the saturation of the filter material. For instance, upon detection of a defined concentration of contaminants in the sample of air by the MOS sensor, the signal can be provided to the controller and the controller can provide an indication that the filter material has reached a defined portion of its life (e.g., end of its life).

In an example, a permeable membrane 134, 136 can be placed across the first opening 116 and the second opening 122. Alternatively, and/or in addition, permeable membranes 138-1, 138-2 can be placed over each respective exit of the first path 114 and the second path 120. In an example, the permeable membranes 138-1, 138-2 can allow air and/or contaminants to pass through, but do not allow the absorbent 132-1, 132-2, desiccant, and/or filter material 106 to pass through. For instance, the permeable membrane can be porous, and can include varying sizes of pores that are sized to prevent passage of the absorbent 132-1, 132-2, desiccant, and/or filter material. In an example, the permeable membrane 134 placed across the first opening 116 can be a cylindrical piece of material that fits in the channel (e.g., felt).

For instance, the permeable membrane 134 can encircle the insert 112 to prevent the filter material 106 from entering the first path 114 (e.g., serving as a barrier) and prevent the absorbent 132-1 from exiting the first path 114. The porous membrane 134 placed across the first opening 116 can be permeable to air, allowing air to enter the first path 114.

Alternatively, and/or in addition, the permeable membrane 136 placed across the second opening 122 can prevent the filter material 106 from entering the second path 120 (e.g., serving as a barrier) and prevent the absorbent 132-2 from exiting the second path 120. The porous membrane 136 placed across the second opening 122 can be permeable to air, allowing air to enter the second path 120.

Figure 1B:
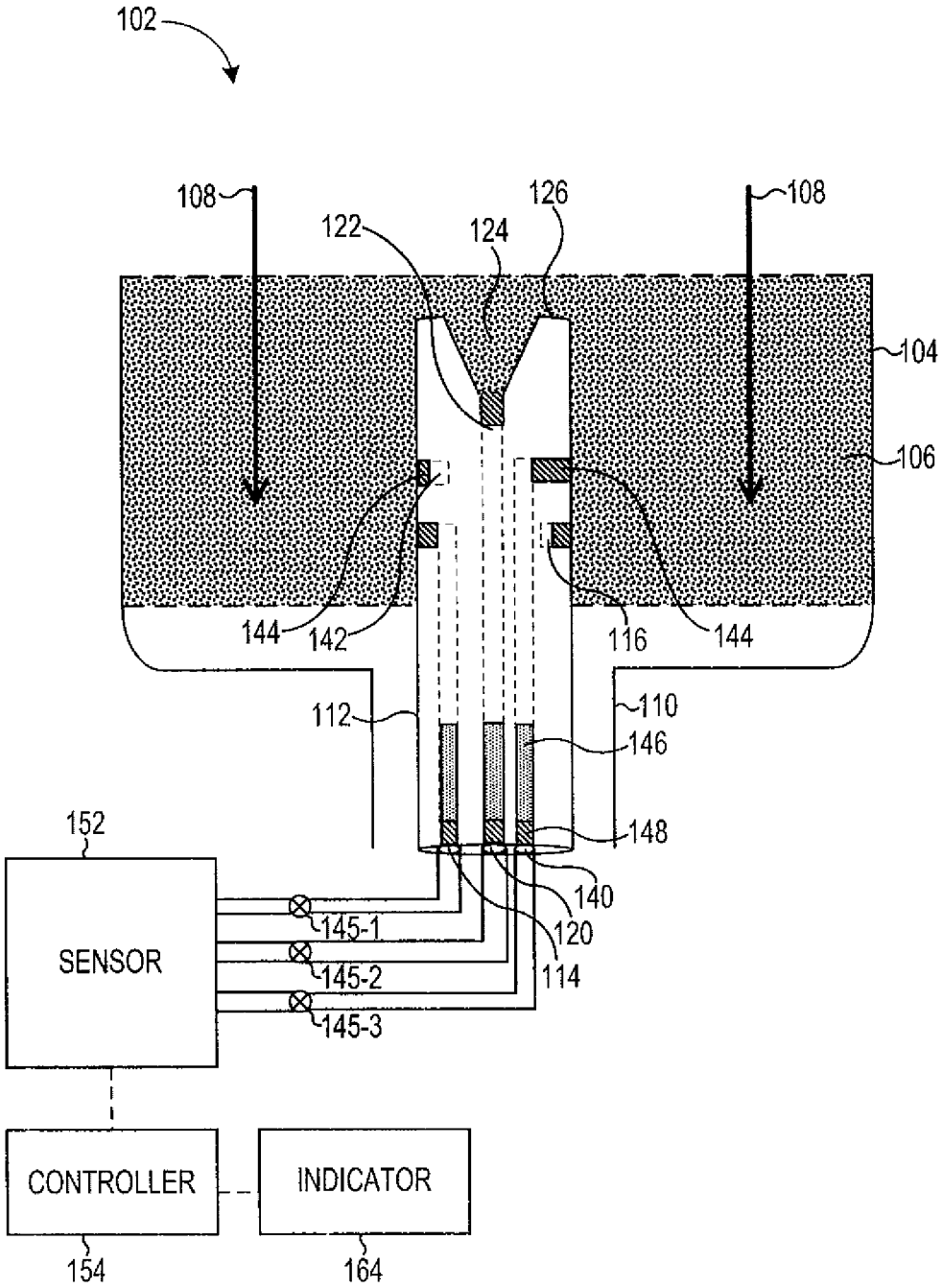
FIG. 1B illustrates a cross section view of a cartridge according to one or more embodiments of the present disclosure.

FIG. 1B illustrates a cross section view of a cartridge according to one or more embodiments of the present disclosure. The cartridge 102 contains the same and/or similar features as those discussed in relation to FIG. 1 A. Alternatively, and/or in addition, the cartridge 102 can include an insert 112 with a third path 140 with a third opening 142 to provide a sample of air that is representative of a saturation of the filter material at a location associated with the third opening 142.

The third path 140 and/or first path 114 can encircle the insert 112. In an example, the third path 140 and/or first path 114 can include a channel (e.g., ring) that is cut into the insert 112. In an example, the channel can be cut into the insert 112 such that the channel connects with the first path 114 or third path 140. For example, a first channel can be cut into the insert 112 that connects to a first opening 116 associated with the first path 114 and/or a second channel can be cut into the insert 112 that connects to a third opening 142 associated with the third path 140.

For instance, air and/or contaminants can be drawn into the first path 114 and/or third path 140 equally from any radial position of the insert 112 via the first channel and/or second channel. As such, if contaminants penetrate the filter material 106 more quickly in one area than in another area, the contaminants will still be drawn into either one of the channels that can be cut into the insert 112. The channels can be cut deep and long enough to provide a larger sample point and to couple to the first path 114 and/or third path 140. The channels may have parallel sides, or may have angled sides, being larger at the perimeter of the insert 112.

In a manner analogous to that discussed in relation to the first 114, the third path 140 can include permeable membranes 144, 148 to stop filter material from entering the third path 140. Alternatively, and/or in addition, absorbent 146 can be placed in the third path 140, which can be kept in place by the permeable membranes 144, 148.

In an example, the position of the third opening 142 can be selected to be in the filter material 106 at a position that is further away from the second end of the container 104 than the first opening 116. This can ensure that contaminants begin to flow through the third opening 142 before they begin to flow through the first opening 116. As such, a sample of air that is representative of a saturation of the filter material 106 can be provided to the sensor via the third path 140 from a location associated with the third opening 142. The third opening 142 can be at a different depth of the filter cartridge than the first opening 116. In an example, the sensor can be configured to provide an indication when a second portion of the filter material 106 is saturated based on the sample of air that is representative of the saturation of the filter material 106 at the location associated with the third opening 142.

For instance, an indication can be provided that the cartridge 102 has reached a fraction of its service life based on the sample received from the third path 140. In an example, because the third opening 142 is closer to an input of airflow into the cartridge 102 than the first opening 116, contaminants can begin to flow through the third path 140 sooner than they flow through the first path 114. As such, an indication can be provided when a fraction of the filter material 106 has been saturated with contaminants. Accordingly, the indication can be provided to the user to indicate a remaining amount of time before the filter needs to be changed.

In an example, a first indication can be provided to the user that indicates when a fraction of the cartridge 102 service life has been reached based on the sample obtained through the third path 140 and a second indication can be provided based on the sample obtained through the first path 114. In an example, the indications can be different so a user can distinguish between the first indication and the second indication. For instance, the indication can be visual and can include different colored lights and/or a different number of lights, and/or can be audible and can include different sounds.

In some embodiments, a sensor 152 can receive the sample of air that is representative of the saturation of the filter material 106 and the filtered sample of air. Alternatively, and/or in addition, the sensor 152 can receive the sample of air that is representative of the saturation of the filter material 106 provided from the location associated with the third opening 142. In an example, a controller (e.g., computing device) 154 can receive a signal from the sensor 152 and determine whether the cartridge 102 needs replacing. For example, the controller 154 can determine that the cartridge 102 needs replacing based on the sample of air from the first path 114. Alternatively, and/or in addition, the controller 154 can determine that the cartridge 102 has reached a fraction of its service life based on the sample of air from the third path 140. In an example, the sensor 152 can receive the filtered sample of the air (e.g., reference sample) from the second path 120 and can thus account for signal drift in the sensor, as discussed herein.

In an example, the controller 154 can detect when the cartridge 102 has reached a fraction of its service life and/or has reached its service life based on a measured difference in outputs produced by the sensor's 152 analysis of the filtered sample of air and the sample of air that is representative of the saturation of the filter material 106 and/or between the filtered sample of air and the sample of air that is representative of the saturation of the filter material 106 that is provided from the location associated with the third opening 142. For example, when the output associated with the sensor measurements of samples of air containing contaminants exceeds the output associated with the sensor measurement of the clean reference sample by a defined value, an indication can be generated. In an example the threshold can be chosen for an alkane such as hexane, since alkanes are among the least reactive organic vapors.

In an example, the controller 154 can be in communication with valves 145-1, 145-2, 145-3 to control the valves. For instance, each valve 145-1, 145-2, 145-3 can be activated individually to control when the air sample from the first path 114 is received by the sensor 152, when the air sample from the second path 120 is received by the sensor 152, and when the air sample from the third path 140 is received by the sensor 152. As such, the sensor can analyze each sample individually.

In some embodiments, the controller 154 can receive a signal from the sensor 152 and determine whether the cartridge 102 needs replacing. For instance, the controller 154 can analyze the reference sample from the second path 120 to account for any signal drift associated with the sensor 152. The controller 154 can analyze the sample obtained from the third path 140 and determine if a defined concentration of contaminants is present in the sample from the third path 140. If the controller 154 determines that the defined concentration of contaminants is not present in the sample from the third path 140, no indication may be made by the controller. However, if the controller 154 determines that the defined concentration of contaminants is present in the sample from the third path 140, the controller 154 can generate an indication through the indicator 164, as discussed herein.

The controller 154 can analyze the sample obtained from the first path 114 and determine if a defined concentration of contaminants is present in the sample from the first path 114. If the controller 154 determines that the defined concentration of contaminants is not present in the sample from the first path 114, no indication may be made by the controller. However, if the controller 154 determines that the defined concentration of contaminants is present in the sample from the first path 114, the controller 154 can generate an indication through the indicator 164, as discussed herein; that the cartridge has reached an end of its service life and/or needs replacing, for example.

Figure 2:
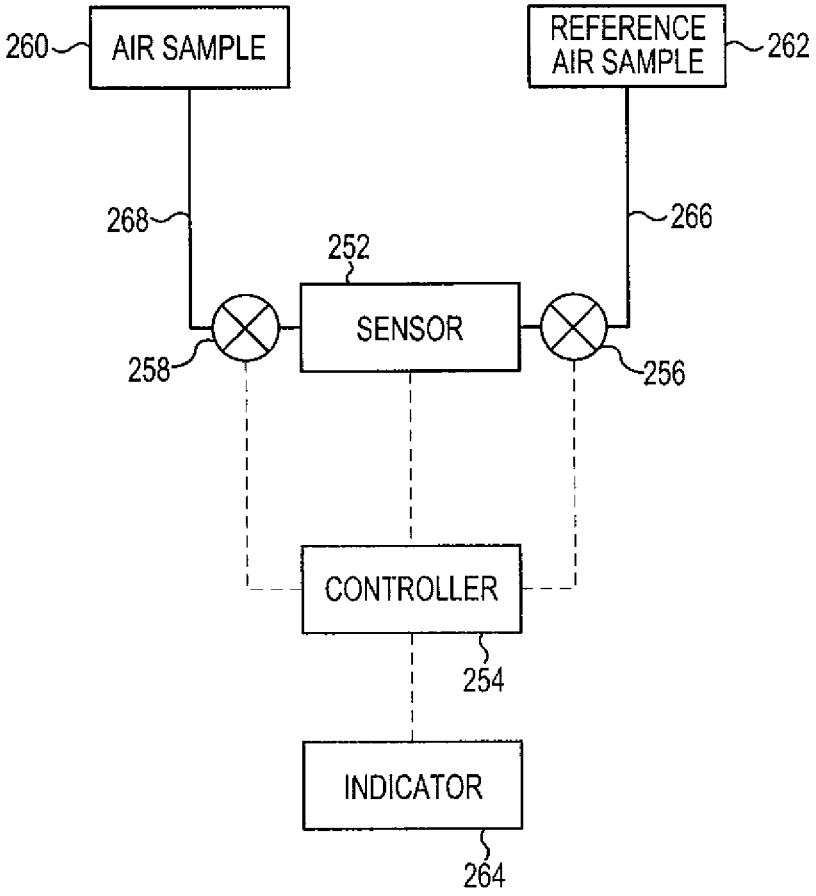
FIG. 2 illustrates a block diagram of a system according to one or more embodiments of the present disclosure.

FIG. 2 illustrates a block diagram of a system according to one or more embodiments of the present disclosure. The system can include a controller 254 (e.g., computing device) in communication with a sensor 252, valves 256, 258, and indicator 264. The controller 254 can control the valves 256, 258. In an example, the controller 254 can implement algorithms to determine the saturation level of the cartridge. Alternatively, and/or in addition, the controller 254 can be coupled to the indicator 264 to provide an indication to a user of the respirator in which the system is implemented.

As discussed herein, the sensor 252 can be an MOS sensor, in an example. The sensor 252 can receive an air sample 260 and a reference air sample 262, as discussed herein. In an example, the air sample 260 can include contaminants that are present in filter material associated with the respirator that have been deposited in the filter material after some use of the respirator and can be received via a second pathway 268. In some embodiments, the sensor 252 can receive multiple air samples 260.

For instance, a first air sample can be from a first depth of the filter material associated with a respirator and a second air sample can be from a second depth of the filter material associated with the respirator. As the respirator is used, contaminants can be provided from the first air sample to the sensor first and a first indication can be provided by the controller 254 through the indicator 264 and contaminants can be provided from the second air sample to the sensor second and a second indication can be provided by the controller 254 through the indicator 264.

In an example, a reference air sample 262 can be received by the sensor 252 via a first path 266. As discussed herein, the reference air sample 262 may contain little or no concentration of contaminants and can be used to compensate for any signal drift associated with the sensor 252. In an example, a first valve 256 can control when the reference air sample 262 is received by the sensor 252 and a second valve 258 can control when the air sample 260 is received by the sensor 252.

In an example, a three-way valve can be used in place of the first valve 256 and the second valve 258. For instance, the sensor 252 can analyze the air sample 260 for a period of time and can then analyze the reference air sample 262 for a period of time. Alternatively, and/or in addition, the system can include multiple sensors 252. For example, a sensor 252 can be dedicated to the air sample 260 and a sensor 252 can be dedicated to the reference air sample 262 such that a single sensor does not need to analyze both the air sample 260 and the reference air sample 262.

In an example, the controller 254 can be coupled to a sensor to sense whether or not the respirator is being used. If it is not being used, energy savings may be realized by switching off or reducing power to the sensors, any heaters, or circuitry of the controller 254. The sensor 252 may be operated at a low power in one embodiment to operate as a flow sensor. When flow is detected, such as that caused by a user starting to breathe, the power may be restored. Alternatively, and/or in addition, a sensor can be a physical switch to turn the respirator on or off. In some embodiments, a sensor may include a humidity sensor to provide humidity readings to algorithms utilized to evaluate data from the gas sensor to process gas sensor signals.

In some embodiments, one or more sensors, such as a flow sensor and a humidity sensor may be used to provide further information to the controller 254. Information provided by the flow sensor may be used to confirm that the gas channels are not clogged, or in power management of the gas sensor. In some embodiments, heater power of the gas sensor can be switched off when there is no flow for a defined time (e.g., respirator is not being used).

Figure 3:
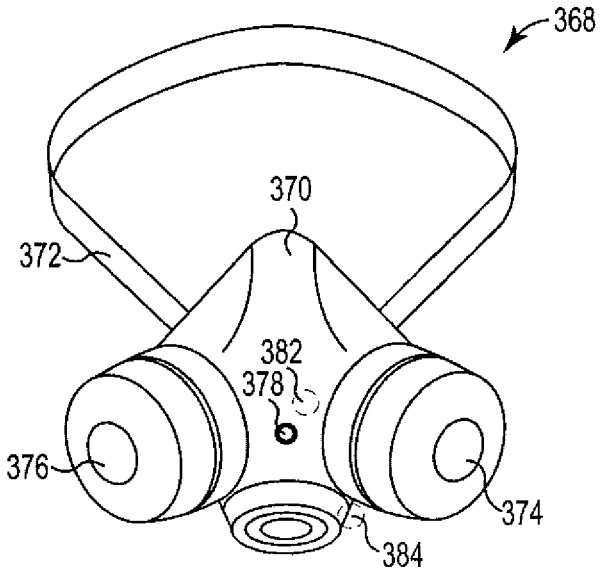
FIG. 3 illustrates a respirator having two respirator cartridges according to one or more embodiments of the present disclosure.

FIG. 3 illustrates a respirator having two respirator cartridges according to one or more embodiments of the present disclosure. The respirator 368 includes a face mask 370 having straps 372 for coupling the respirator 368 to a face of a user. The face mask 370 has two receptacles for two cartridges 374, 376 to provide passages for filtered air to a wearer of the mask. Note that exhaled air may leave the mask through a one way valve, and is not returned to the cartridges 374, 376.

In some embodiments, at least one cartridge has an insert as discussed in relation for FIG. 1. Having at least one cartridge with an insert to allow for testing of the filter material in the cartridge is sufficient, as both cartridges can have filter material being used at about the same rate. The cartridge with the insert may be sensed as becoming filled with contaminants more quickly, because if it has the same size cartridge, the cartridge without the insert may have more filter material and may become consumed more slowly. In some embodiments, both cartridges can have inserts to test each cartridge independently.

In some embodiments, an optical indicator 378 may be included in the mask and controlled by a controller to indicate when the cartridges need replacing. The optical indicator 378 may be a light emitting diode (LED) or other visible indicator that is controlled by a controller that also may keep track of use of the respirator, and provide battery monitoring. In one embodiment, a battery may be mounted on the strap 372 behind the head of the user to balance the weight of the respirator and not make the mask heavier than it needs to be.

In some embodiments, the control electronics may be located in several different positions, such as at 382 on or within the face mask 370, or at 384 on clothing of the user. The controller can be powered and by placing it on something separate from the cartridges, it may be easily placed on the cartridge in some embodiments, and have a self-contained power supply or connection to a power supply.

Figure 4:
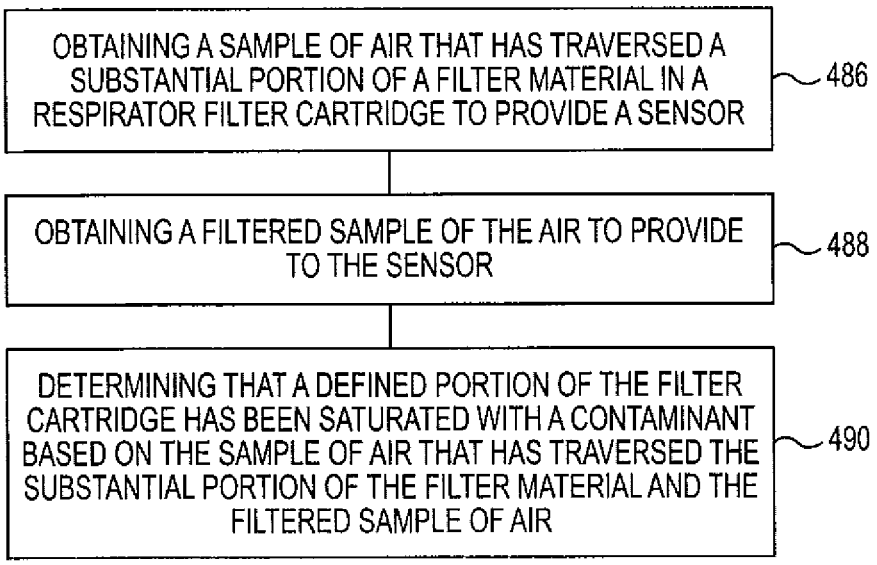
FIG. 4 illustrates a method according to one or more embodiments of the present disclosure.

FIG. 4 illustrates a method according to one or more embodiments of the present disclosure. In some embodiments, the method can include obtaining a sample of air that has traversed a substantial portion of a filter material in a respirator cartridge, at block 486. In an example, an insert can be placed in the filter cartridge with a first path and a second path. The first path can have an opening in an exterior wall of the insert as discussed herein and the second path can have an opening in a recessed portion located at a first end of the insert, as discussed herein. The opening of the first path can be located in the filter material at a position similar as that discussed in relation to FIG. 1. In an example, upon initial use, the air can travel through the filter material and a majority of contaminants can be filtered out of the air by the filter material, before the air enters the first path and is provided to the sensor. After some use, contaminants may begin to travel through the filter material and through the first path In some embodiments, the method can include obtaining a filtered sample of the air to provide to the sensor, at block 488. For instance, the second path can provide a filtered sample of the air to the sensor. As discussed herein, the second path can have an opening in the recessed portion located at the first end of the insert. The flow rate of air traveling through the recessed portion and through filter material located in the recessed portion can be approximately 1 milliliter per minute. As such, the filter material located in the recessed portion can filter contaminants from the air that travels through the recessed portion. The filtered sample of air can be used to compensate for signal drift associated with the sensor, as discussed herein.

In some embodiments, the method can include, at block 490, determining that a defined portion of the cartridge has been saturated with a contaminant based on the sample of air that has traversed the substantial portion of the filter material and the filtered sample of the air. In an example, as the filter cartridge is used, contaminants can begin to saturate the cartridge. As such, contaminants can travel through the filter material and into the opening associated with the first path and can be provided to the sensor. The sensor can detect the presence of the contaminants and when a level (e.g., concentration) of contaminants reaches a defined point, the determination that the defined portion of the cartridge has been saturated with the contaminants can be made.

As discussed herein, the filtered sample of air can be used to compensate for signal drift associated with the sensor. For example, when the sensor is an MOS, the signal produced by the MOS can drift, even when the MOS is not sensing any concentrations of contaminants, which can affect an accuracy associated with the MOS. As such, by providing the filtered sample of the air to the MOS, any signal drift can be accounted for by analyzing the filtered sample of air with the MOS.

Upon detection of the presence of the contaminants, a warning can be provided through an audible and/or visual indicator, for example. The audible and/or visual indicator can indicate that an end of the service life of the cartridge has been reached, and/or that a fraction of the service life of the cartridge has been reached. For example, the indicator can issue a warning that the fraction of the service life of the cartridge has been reached upon analysis of a sample obtained from a third path, as discussed in relation to FIG. 1.

Some prior approaches have shut down the sensor upon detecting that the end of the service life of the cartridge has been reached. In such an approach, the sample that has traversed the substantial portion of the filter material and contains contaminants is provided to the sensor for detection of contaminants. Upon detecting a defined level of contaminants (e.g., end of service life), the sensor can be shut down to save power, thus turning off a heater associated with the sensor and thereby avoiding combustion of vapors on the sensor where they could negatively impact future sensor performance.

To help address the limitations associated with this prior approach, in some embodiments, the method can include providing the filtered sample of the air to the sensor upon determining that a defined portion of the cartridge has been saturated with the contaminant. For example, when the end of the service life of the cartridge has been reached, the filtered sample of the air can be provided to the sensor, rather than the sample of air from the first path that contains the contaminants. In an example, a valve can control the flow of the sample of air that has traversed a substantial portion of the filter material to the sensor and the flow of the filtered sample of air to the sensor. In an example, one valve can control the flows or different valves can control each of the flows.

Upon determining that the defined portion of the cartridge has been saturated with the contaminant, a valve controlling the sample of air that has traversed the substantial portion of the filter material and/or the filtered sample of air can close to a position that stops the flow of the sample of air that has traversed the substantial portion of the filter material to the sensor. In addition, the valve controlling the filtered sample of air can open to a position that allows the filtered sample of air to reach the sensor. As such, filtered air that does not contain contaminants can flush the sensor of contaminants, avoiding a possibility of leaving combustion products on the sensor.

Alternatively, and/or in addition, upon determining that the defined portion of the cartridge has been saturated with the contaminant, the sensor can be heated to a given temperature for a period of time. In an example, the sensor can be heated to a temperature above a normal operational temperature that the sensor operates at when sensing contaminants or can be heated to a temperature that is approximately the same as the temperature that the sensor operates when sensing contaminants. For example, by heating the sensor, reaction products from sulfur compounds can be combusted (e.g., burned away) from the sensor and the sensor can be reset, at least partially, to a known state.

Alternatively, and/or in addition, after the filtered sample of air is provided to the sensor and the sensor has been heated, the sensor can be shut down. By shutting the sensor down, energy can be saved and by following a shut-down procedure, as discussed herein, future sensor performance may be negatively impacted less than in prior approaches.

In some embodiments, the method can include alternating between providing the sample of air that has traversed the substantial portion of the filter material and the filtered sample of air to the sensor. In an example, by alternating between providing the two samples to the sensor, one sensor can be used. In some embodiments, the samples can be alternately provided to the sensor through use of one valve. For example, the valve can be switched to each sample of air in an alternating manner.

In some embodiments, the method can include a start-up procedure. In an example, the start-up procedure can include determining that the sensor has been inactive for a defined period of time. For example, the respirator may have sat unused for a period of time and the sensor may have been turned off to conserve energy. During the period of time, the sensor may have been exposed to contaminants which may have been deposited on the sensor because the sensor was not heated during the time of inactivity. If the sensor is activated (e.g., heated) without following the start-up procedure, as discussed herein, damage may occur to the sensor, affecting an accuracy associated with the sensor.

In an example, the start-up procedure can include providing the filtered sample of air to the sensor. By providing the filtered sample of air to the sensor, the air surrounding the sensor can be flushed of any contaminants before the sensor is activated, thus reducing a possibility of negatively affecting the accuracy of the sensor.

Alternatively, and/or in addition, the start-up procedure can include increasing the temperature of the sensor to a defined temperature. In an example, the defined temperature can be a temperature that is the same as an operational temperature that the sensor operates at and/or is greater than an operational temperature that the sensor operates at. By heating the sensor, most contaminants that have been deposited on the sensor and/or are present in the air surrounding the sensor can be thermally desorbed before the sensor is operated. As such, an accuracy of the sensor can be increased by following the start-up procedure.

In an example, the temperature of the sensor can be increased in a defined manner. The temperature of the sensor can be increased in steps. In an example, the temperature can be increased incrementally in steps. For instance, incrementally increasing the temperature in steps can include heating the sensor to a temperature and holding the sensor at the temperature for a defined time before further increasing the temperature of the sensor to a second temperature.

Figure 5:
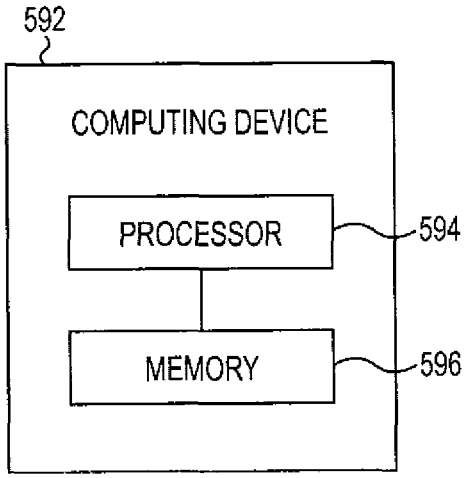
FIG. 5 illustrates a computing device according to one or more embodiments of the present disclosure.

FIG. 5 illustrates a computing device according to one or more embodiments of the present disclosure. The computing device can be a controller, among other types of computing devices, as discussed in relation to FIGS. 1 to 3 and can perform the method discussed in relation of FIG. 4.

As shown in FIG. 5, computing device 592 (e.g., controller) includes a processor 594 and a memory 596 coupled to the processor 594. Memory 596 can be any type of storage medium that can be accessed by the processor 594 to perform various examples of the present disclosure. For example, memory 596 can be a non-transitory computer readable medium having computer readable instructions (e.g., computer program instructions) stored thereon that are executable by the processor 594 to control an end of service life indicator for a respirator according to one or more embodiments of the present disclosure.

Memory 596 can be volatile or nonvolatile memory. Memory 596 can also be removable (e.g., portable) memory, or non-removable (e.g., internal) memory. For example, memory 596 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 596 is illustrated as being located in computing device 592, embodiments of the present disclosure are not so limited. For example, memory 596 can also be located internal to another computing resource (e.g., enabling computer readable instructions to be downloaded over the Internet or another wired or wireless connection).

Computing device 592 can include a user interface. The user interface can be a graphic user interface (GUI) that can provide (e.g., display and/or present) and/or receive information (e.g., data and/or images) to and/or from a user (e.g., operator) of computing device 592. For example, the user interface can include a screen that can provide information to a user of computing device 592 and/or receive information entered into a display on the screen by the user. However, embodiments of the present disclosure are not limited to a particular type of user interface.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

What is claimed:

1. A device, comprising:

a cartridge containing a filter material;

an insert extending through at least a portion of the filter material having a first path with a first opening located on a side of the insert configured to provide a sample of air that is representative of a saturation of the filter material and a second path with a second opening configured to provide a filtered sample of the air throughout a service life of the cartridge, wherein the first path and the second path extend longitudinally along the insert;

a sensor for sensing a saturation level of filter material; and a controller that compares a saturation level of a sample of air that is representative of the saturation of the filter material and the filtered sample of the air to determine signal drift is associated with the sensor, wherein the filtered sample of air is used to compensate for the signal drift associated with the sensor.

2. The device of claim 1, wherein:

the second opening is located within a recessed portion of a first end of the insert; and the recessed portion is configured to provide a flow density associated with the filtered sample of the air through the second opening that is lower than a flow density associated with air passing through filter material surrounding the insert.

3. The device of claim 2, wherein an end of service life is defined as a time at which a defined concentration of a contaminant is sensed via-the sensor in the sample of air that is representative of the saturation of the filter material.

4. The device of claim 2, wherein the recessed portion of the first end of the insert is filled with the filter material.

5. The device of claim 1, wherein:

the cartridge includes an adapter configured to couple to the sensor to provide the samples of air to the sensor;

the adapter is configured to couple a second end of the insert to the sensor.

6. The device of claim 1, wherein an absorbent is placed in at least one of the first path and the second path.

7. The device of claim 6, wherein the absorbent includes molecular sieves with a pore size of less than 3.5 Angstroms.

8. The device of claim 1, wherein:

a permeable membrane is placed across at least one of the first opening and second opening; and the permeable membrane is permeable to air and provides a barrier for the filter material.

9. The device of claim 1, comprising a third opening to provide a sample of air that is representative of the saturation of the filter material at a location associated with the third opening.

10. The device of claim 9, wherein the sensor is configured to provide an indication when a second portion of the filter material is saturated based on the sample of air that is representative of the saturation of the filter material at the location associated with the third opening.

11. The device of claim 1, wherein the sensor is configured to provide an indication when a portion of the filter material is saturated based on the sample of air that is representative of the saturation of the filter material.

12. A device, comprising:

a cartridge containing a filter material;

an insert extending through at least a portion of the filter material having a first path with a first opening located on a side of the insert to provide a sample of air that is representative of a saturation of the filter material and a second path with a second opening to provide a filtered sample of the air, wherein the first path and the second path extend longitudinally along the insert;

a sensor to receive the sample of air that is representative of the saturation of the filter material and the filtered sample of the air; and a controller that compares a saturation level of the sample of air that is representative of the saturation of the filter material and the filtered sample of the air to determine signal drift is associated with the sensor, wherein the filtered sample of air is used to compensate for the signal drift associated with the sensor.

13. The device of claim 12, further comprising a controller to receive a signal from the sensor and determine whether the cartridge needs replacing.

14. The device of claim 13, further comprising an indicator to indicate that the cartridge needs replacing.

15. The device of claim 12, wherein the first opening encircles the insert and is connected to the first path.

* * * * *